US005836488A

United States Patent [19]

Priestley

[11] Patent Number: 5,836,488

[45] Date of Patent: Nov. 17, 1998

[54] MAIL CARRYING AND ORGANIZING DEVICE

[76] Inventor: Paul Timothy Priestley, 1466 Woodview Rd., Yardley, Pa. 19067

[21] Appl. No.: 719,406

[22] Filed: Sep. 24, 1996

[51] Int. Cl.[6] ..... A45F 5/00

[52] U.S. Cl. ..... 224/222; 224/267; 224/901.8

[58] Field of Search ..... 224/219, 220, 224/221, 222, 223, 665, 267, 901.8, 605

[56] References Cited

U.S. PATENT DOCUMENTS

| | | | |
|---|---|---|---|
| D. 302,073 | 7/1989 | Biggs . | |
| 4,836,428 | 6/1989 | Evans et al. . | |
| 4,848,624 | 7/1989 | Clem | 224/267 |
| 4,974,762 | 12/1990 | Boretsky et al. | 224/222 |
| 5,127,545 | 7/1992 | French | 224/219 |
| 5,215,379 | 6/1993 | Pickard et al. | 224/222 |
| 5,240,156 | 8/1993 | Sicotte et al. | 224/901.8 |
| 5,294,030 | 3/1994 | Jolliuette . | |

FOREIGN PATENT DOCUMENTS

| | | | |
|---|---|---|---|
| 92/22463 | 12/1992 | WIPO | 224/219 |

*Primary Examiner*—Henry J. Recla
*Assistant Examiner*—Gregory M. Vidovich

[57] ABSTRACT

A bag structure for carrying objects, such as mail, on the inner forearm between the elbow and the hand on either the right or left arm. The bag structure includes a divided container comprising of a front wall, a dividing wall spaced from the front wall, a back wall spaced from the dividing wall, spaced apart end walls, a floor, and an open top. A VELCRO armband which straps to the inner forearm and corresponding VELCRO pad on the back of mailbag structure back wall.

2 Claims, 2 Drawing Sheets

MAIL CARRYING AND ORGANIZING DEVICE

BACKGROUND OF THE INVENTION

1. Field of the Invention

This invention relates to body-attachable bags for transporting items, particularly mail, that is worn on the inner human forearm between the elbow and hand on either the right or left arm.

2. Prior Art

With the advent of the "Direct Point Sequencing" (D.P.S.) system and the method of carrying the various bundles of U.S. Postal Mail, the need for a device to hold and organize these bundles is desperate!

"Direct Point Sequence" is bar-coded mail that comes into the Post Office presorted and in order of delivery. The carrier sorts regular mail and carries this separately from D.P.S. mail. The present system of carrying these two different forms of mail by the postal carrier is as follows:

The carrier takes from his or her standard postal bag one relay of mail (one relay of mail is enough mail to do an undetermined number of addresses). The carrier then places the regular mail on the inner forearm then puts the D.P.S. mail in the hand of the same arm. When pulling the mail from the different bundles, the carrier pulls the D.P.S. mail for the respected address and places it between the fingers of the mail holding hand. The carrier then pulls the regular mail from the inner forearm and unites it with D.P.S. mail.

This method is awkward and cumbersome. Some carriers suffer from Carpal Tunnel Syndrome and arthritis of the hand. My device will not aggravate or add to these conditions. Holding a bundle of mail in the hand for a length of time can be painful and harmful, resulting in lost time from work and lost productivity to the Post Office, all of which cost money.

The mail carried on the arm is loose and vulnerable to the elements, especially the wind. Mail carried loose on the arm is subject to being dropped and is very unstable. Sometimes it is necessary for the carrier to fold the mail in order for it to fit into small mail slots or mail boxes. This can be difficult to do with only one free hand.

There are many types of mail carrying devices, one of which is the standard carrier mail bag which is used to carry many units or relays of mail. My device works in conjunction with the standard mail bag already in use.

Other mail carrying devices strap around the waist or suspend from the shoulders. They are designed to carry a large quantity or heavy load.

Some examples are as follows:

(a) U.S. Pat. No. 4,836 issued on Jun. 6, 1989 shows a bag that straps to the waist for carrying heavy loads.

(b) U.S. Pat. No. Des. 302,073 issued on Jul. 11, 1989 shows a bag that suspends from the shoulders with dual bags on either side.

(c) U.S. Pat. No. 5,294,030 issued on Mar. 15, 1994 shows a dual bag that straps to the waist for carrying heavy and large loads.

All of the mail carrying devices heretofore known suffer from one or more of these disadvantages:

(a) they are designed to carry heavy loads;

(b) they are big and restrictive;

(c) they are meant to replace the standard mail bag already in use;

(d) they do not address the D.P.S. carrying system;

(e) they are not light weight;

(f) they cannot be removed quickly and easily; and (g) they do not fit on the inner forearm.

BRIEF SUMMARY AND OBJECTS OF THE INVENTION

Several objects and advantages of the present invention are:

(a) to carry regular mail and D.P.S. mail together while keeping them separate on the arm;

(b) to keep mail organized and stop it from moving around and falling;

(c) to protect mail from the elements, such as rain, wind, etc.;

(d) removable from arm easily and quickly;

(e) keeps both hands free;

(f) does not aggravate arthritis or Carpal Tunnel Syndrome;

(g) is not a safety hazard;

(h) saves the Post Office money, because less fatigue and ailments mean more productivity; and (i) is light weight and small, and does not interfere with body movements.

Further objects and advantages are that the mail bag structure stands up on its own so that it can be easily loaded. Once loaded it is simply positioned on the arm by VELCRO (hook-and-loop fastener). The separate VELCRO armband is secured to the arm. The bag is not permanently secured to the human arm, so removing it for loading and driving is easy. Some people do not like things strapped to their arm, and that is fine.

My device still works as designed without the companion stabilizing arm band. The stabilizing armband is simply to help stabilize and position the bag on the arm.

The arm bag can be the tool to make the current established system of carrying U.S. postal mail practical and reasonable. One of the major complaints of carrying D.P.S. mail by the carrier is that it is awkward and unreasonable to carry.

The arm bag consolidates the two bundles of mail into one convenient and easy to manage unit while keeping the two different types of mail separate.

The arm bag ends the balancing act securing the mail on the arm, and helps to protect the mail from the elements.

The arm bag has two compartments: one larger section in the back for large envelopes and regular mail, and a smaller narrower section in the front for D.P.S. mail. This allows the two different types of mail to be carried together but separate, affording two free hands to use in folding large pieces of mail for proper delivery into small mail slots and mail boxes.

The arm bag is safe to use. It can be removed quickly from the arm for driving or loading.

The arm bag promotes productivity. One only has to put a large bundle of mail in the hand for a length of time to realize the pain and discomfort the present system entails, which does not promote productivity, only fatigue and ailments.

The arm bag is comfortable and light weight, and because of its size, the arm bag does not interfere with body movements. It fits on the inner forearm between the elbow and hand.

Figure 1:
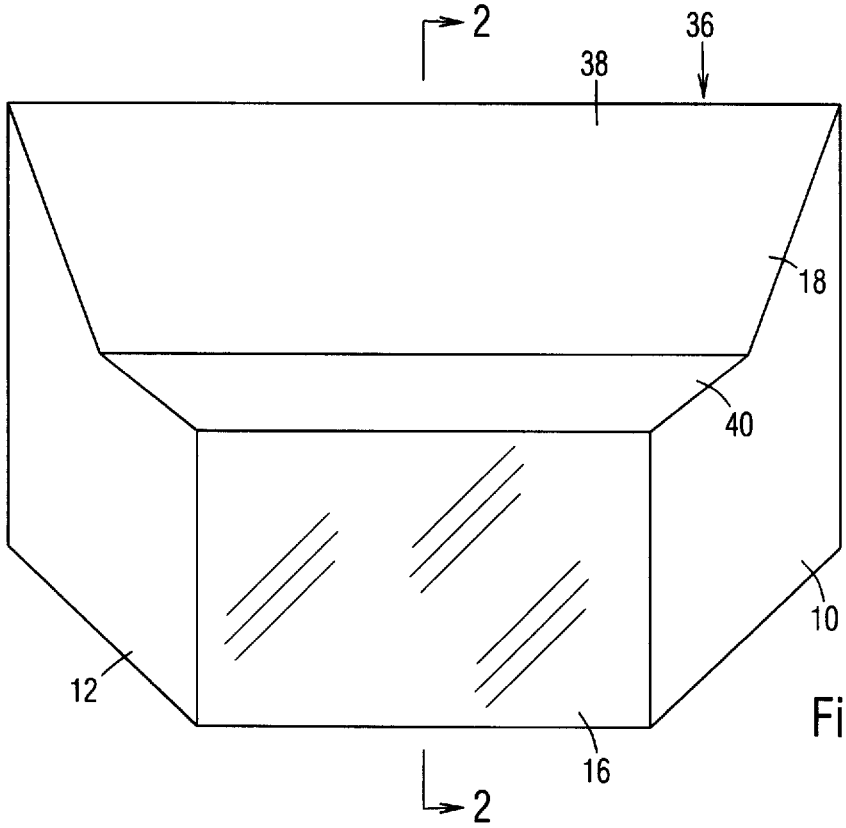
FIG. 1 is a front view of the mail bag.

| DRAWING REFERENCE NUMERALS | |
|---|---|
| 10. Angled Right Side Wall | 12. Angled Left Side Wall |
| 16. Front Clear Wall | 18. Back Wall |
| 20. Back Wall VELCRO Pad | 22. Living Hinge |
| 24. Upward Pivoting Floor | 26. Dividing Wall |
| 28. Right VELCRO Arm Strap | 30. Left VELCRO Arm Strap |
| 32. VELCRO Arm Band Pad | 34. Stabilizing Arm Band |
| 36. Mail Bag Structure | 38. Rear Compartment |
| 40. Front Compartment | |

DETAILED DESCRIPTION OF THE INVENTION

Figure 2:
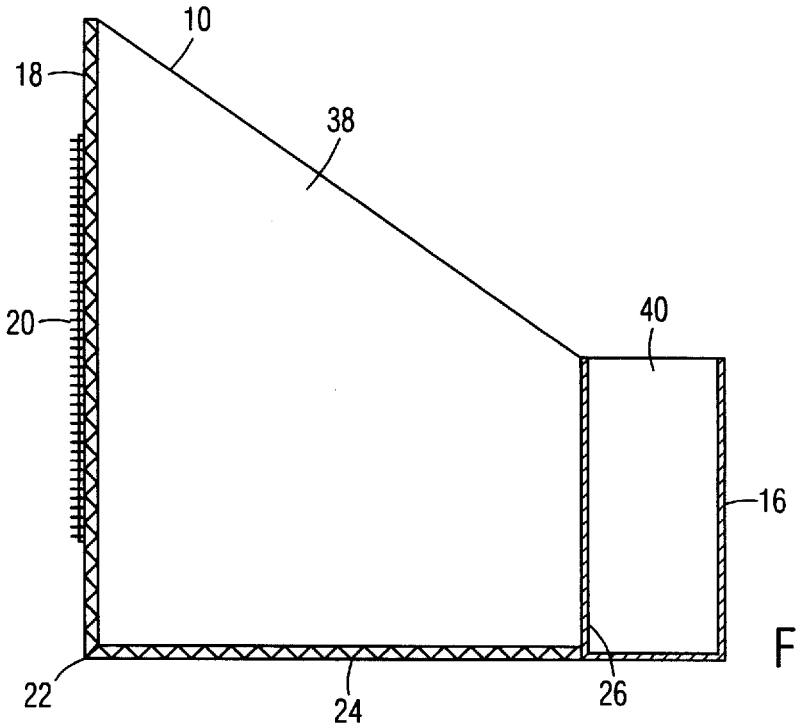
FIG. 2 is a cross sectional view as taken along line 2—2 in FIG. 1.

A typical embodiment of the mail bag structure 36 is illustrated in FIG. 1 (front view), and FIG. 2 (cross sectional view). The mail bag structure 36 has two compartments 38 and 40 for carrying mail. The mail bag structure 36 includes a right side wall 10, a left side wall 12, a front clear wall 16, a dividing wall 26, a back wall 18, and a floor 24. The container has an open top defined by the top edges of side walls 10 and 12, front wall 16, dividing wall 26, and back wall 18. The back wall 18 and the floor 24 are preferably constructed from one piece of corrugated cardboard with a one piece vinyl laminate or heavy canvas laminate. At a point where the back wall 18 and the floor 24 meet there is a crease or living hinge 22 which allows the floor to pivot up for shipping, storage and comfort to the wearer. The side walls 10 and 12 are connected to the back wall 18 and the floor 24, which prevents floor 24 from pivoting down. Front clear wall 16 is preferably made of a strong, flexible see-through plastic to permit viewing of front letter address. Alternatively, front wall 16 may be made of canvas.

Referring to FIG. 1, there is shown an angled right side wall 10 and an angled left side wall 12. The angle of both side walls start at a point where back wall 18 and floor 24 meet, then continue towards each other until reaching front wall 16, thus making back compartment 38 wider then front compartment 40. The side walls 10 and 12 are preferably made of a strong, flexible material, such as canvas for example.

Referring to FIG. 2, there is shown right side wall 10 in which an angle is shown starting from a point where the top of right side wall 10 and the top of back wall 18 meet. From this point an angle extends down towards floor 24 until it meets dividing wall 26, from this point the side wall 10 extends parallel to floor 24 until it meets front clear wall 16. The left side wall 12 mirrors right side wall 10 in this respect.

Figure 3:
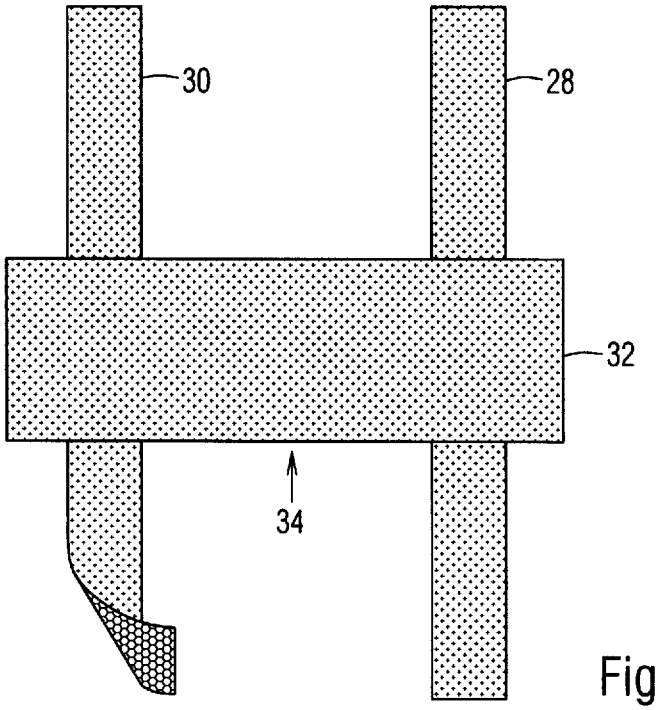
FIG. 3 is an overhead view of a VELCRO stabilizing arm band for the mail bag.

Referring to FIG. 3, there is shown an overhead view of a VELCRO stabilizing arm band 34. The arm band 34 is comprised of a VELCRO pad 32 and two VELCRO straps 28 and 30. On the face side, i.e., the side being shown, of VELCRO pad 32 is the "hooks" part of the VELCRO, with the back being plain. The VELCRO arm pad 32 is preferably constructed of a rigid material, such as corrugated cardboard laminated with plastic or canvas, for example, with the "hooks" part of the VELCRO attached to the face side, either by glue or stitching. On the back side of arm pad 32, the VELCRO arm straps 28 and 30 are attached either by riveting or stitching. The VELCRO arm straps 28 and 30 have "hook" VELCRO on the face side and "mesh" VELCRO on the backside. The "mesh" is shown on an upturned corner of strap 30. When the VELCRO straps 28 and 30 are wrapped around the arm of wearer, the opposite sides meet, creating a connection.

Figure 4:
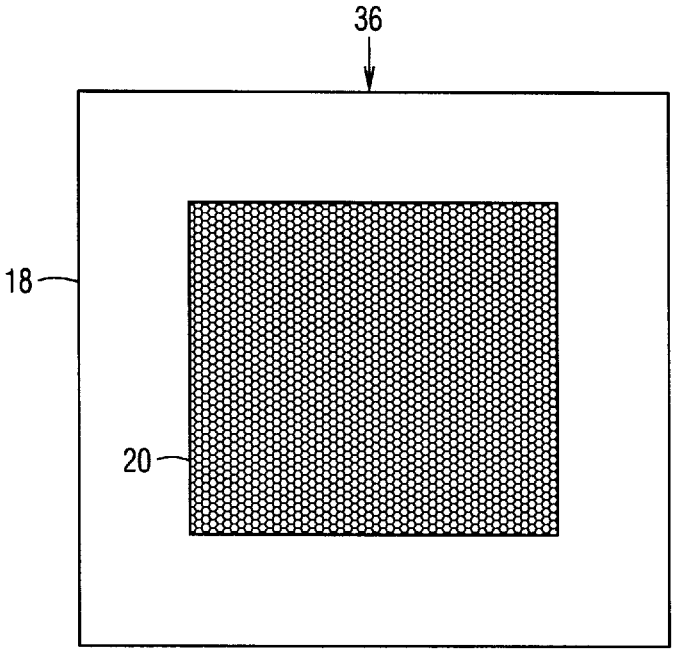
FIG. 4 is a back view of the mail bag.

In FIG. 4 there is shown the rear of back wall 18. In the center is a square VELCRO pad 20 consisting of the "mesh", part of the VELCRO which corresponds to the VELCRO arm pad 32. When the wearer attaches VELCRO stabilizing arm band 34 to either the right or left inner forearm, the mail bag 36 can be attached to the arm simple by laying back wall VELCRO pad 20 on top of VELCRO arm pad 32.

OPERATION OF THE INVENTION

The manner of using mail bag structure 36 is as follows:

a) place stabilizing arm band 34 on either the right or left inner forearm, and wrap VELCRO arm straps 28 and 30 around the arm;

b) place mail bag structure 36 on a flat even surface, and the mail bag will stand up on its own;

c) place regular mail in rear compartment 38 and D.P.S. mail in front compartment 40;

d) place mail bag 36 on the inner forearm, lining up VELCRO pad 20 with VELCRO arm pad 32; and e) hold mail bag structure 36 to permit floor 24 to contact the wearer's body for support.

SUMMARY AND SCOPE

Accordingly, the reader will note that the mail carrying and organizing device can be used to organize, carry, and separate different types of mail. The user will not be hampered with loose mail or large unmanageable bundles carried openly on the forearm and in the hand. Furthermore, the present invention has additional advantages. A design can consist of many divided pockets which can range in size to accommodate the use at hand or can consist of no divided pockets and be one large pocket. The mail bag structure can be made of any firm and or flexible materials. The front wall panel can be solid non-transparent, or clear transparent or non-glare frost-like finish. The mail bag structure can be of any color, however, the dividing walls preferably should be of a bright color different from the rest of the structure for quick visual reference. User can carry U.S. Postal Mail, office business mail or any object that can fit inside the bag structure. The mail bag can be of any size, as long as it can fit on the inner forearm between the elbow and the hand on the average adult human body.

Although the description above contains many specifications, these should not be construed as limiting the scope of the invention, but merely providing illustrations of some of the preferred embodiments of this invention. For example, the side walls can have different angles, or no angles at all. The height of the back wall could be higher or lower. The floor could be one thickness from back to front. The hinged floor can be accomplished in many different ways. The VELCRO stabilizing armband could be of any size, as long as it can fit on the inner forearm between the elbow and hand of the average adult human body. Thus the scope of the invention should be determined by the appended claims and their legal equivalents, rather then by the example given.

I claim:

1. A bag structure for carrying mail, the structure adapted to be worn on a person's inner forearm between the elbow and the hand, the structure comprising:

a divided container having a front wall, a back wall, at least one dividing wall spaced from said front and back wall and located therebetween, opposing end walls, and a floor wherein said container includes an open top defined by respective top edges of said front wall, said back wall, said end walls, and said at least one dividing wall;

an armband adapted to be releasably connected about the forearm of a person, wherein said armband has a length which is less than a length of said back wall; and an armband attachment means connected to said back wall of said container for providing a removable connection between said container and said armband such that a longitudinal axis of said armband is substantially parallel to said top edge of said back wall, said armband comprising an armband pad and two straps coupled to said pad, said two straps adapted to be wrapped and secured around the forearm of a person, wherein:

a) said front wall is formed from a clear plastic material;

b) said at least one divider having a color which differs from a remaining portion of said structure;

c) said back wall is formed from corrugated cardboard which is laminated with one of vinyl and canvas material and which is creased at a point to form an angle having substantially facing sides with one side thereof forming said back wall and another side forming said floor;

d) said end walls are connected to said back wall and said floor;

e) each of said end walls being formed of canvas;

f) said attachment means comprising one of a hook-and-loop fastener; and g) said armband pad being formed of corrugated cardboard laminated with one of plastic and canvas material, said armband pad having the other of said hook-and-loop fastener such that it may detachably connect to said attachment means, said two straps each having opposing end portions having attachment means thereon cooperable with each other for securing said straps to the forearm of a person.

2. A bag structure for carrying mail, the structure adapted to be worn on a person's inner forearm between the elbow and the hand, the structure comprising:

a container having a front wall, a back wall spaced from said front wall, opposing end walls, and a floor wherein said container includes an open top defined by respective top edges of said front wall, said back wall, and said end walls;

an armband adapted to be releasably connected about the forearm of a person, wherein said armband has a length which is less than a length of said back wall; and an armband attachment means connected to said back wall of said container for providing a removable connection between said container and said armband such that a longitudinal axis of said armband is substantially parallel to said top edge of said back wall, said armband comprising an armband pad and two straps coupled to said pad, said two straps to be wrapped and secured around the forearm of a person, wherein:

a) said front wall is formed from one of a clear canvas plastic material;

b) said back wall is formed from corrugated cardboard which is laminated with one of vinyl and canvas material and which is creased at a point to form an angle having substantially facing sides with one side thereof forming said back wall and another side forming said floor;

c) said end walls are connected to said back wall and said floor;

d) each of said end walls being formed of canvas;

e) said attachment means comprising one of a hook-and-loop fastener; and f) said armband pad being formed of corrugated cardboard laminated with one of plastic and canvas material, said armband pad having the other of said hook-and-loop fastener such that it may detachably connect to said attachment means, said two straps each having opposing end portions having attachment means thereon cooperable with each other for securing said straps to the forearm of a person.

* * * * *